US008752801B2

(12) United States Patent
Parquette

(10) Patent No.: US 8,752,801 B2
(45) Date of Patent: Jun. 17, 2014

(54) APPARATUS AND KIT FOR SUPPORTING INCLINED STRUCTURES

(76) Inventor: Maria Parquette, Tinley Park, IL (US)

( * ) Notice: Subject to any disclaimer, the term of this patent is extended or adjusted under 35 U.S.C. 154(b) by 3 days.

(21) Appl. No.: 13/295,237

(22) Filed: Nov. 14, 2011

(65) Prior Publication Data

US 2012/0211619 A1 Aug. 23, 2012

Related U.S. Application Data

(63) Continuation-in-part of application No. 13/030,181, filed on Feb. 18, 2011.

(51) Int. Cl.
*E04G 3/30* (2006.01)

(52) U.S. Cl.
USPC ..... 248/235; 182/45

(58) Field of Classification Search
USPC ..... 248/315, 505, 237, 235, 220.21, 248/220.22, 241, 242, 247, 248, 250; 182/45; 52/173.1
See application file for complete search history.

(56) References Cited

U.S. PATENT DOCUMENTS

| | | | | |
|---|---|---|---|---|
| 4,249,713 | A * | 2/1981 | Glynn et al. | 248/237 |
| 5,730,407 | A * | 3/1998 | Ostrobrod | 248/237 |
| 6,009,973 | A * | 1/2000 | Woodyard | 182/36 |
| 6,082,689 | A | 7/2000 | Bushway | |
| D440,672 | S * | 4/2001 | Alexander | D25/199 |
| 6,227,329 | B1 * | 5/2001 | Ador | 182/3 |
| 6,668,509 | B1 * | 12/2003 | Krebs | 52/698 |
| 6,928,783 | B2 * | 8/2005 | Oliver et al. | 52/699 |
| 7,240,770 | B2 * | 7/2007 | Mullins et al. | 182/3 |
| 7,665,248 | B2 * | 2/2010 | Blackford | 52/27 |
| 2005/0167201 | A1 | 8/2005 | Young et al. | |

* cited by examiner

*Primary Examiner* — Steven Marsh
(74) *Attorney, Agent, or Firm* — Scherrer Patent & Trademark Law, P.C.; Stephen T. Scherrer

(57) ABSTRACT

The present invention relates to an apparatus and kit for use in supporting inclined objects and structures. Specifically, the present invention relates to an apparatus and kit useful for extending platforms on a roof in which scaffolding can be built upon. More specifically, the apparatus relates to an interconnected anchoring section designed to support the weight of equipment and individuals working on an inclined surface. The apparatus includes, generally, an anchoring section to attach to the peak of a rooftop or other inclined surface, and an attaching surface to connect the anchoring section to the platform section. The platform section allows equipment to be built thereon without damaging the roof or surface beneath.

8 Claims, 7 Drawing Sheets

APPARATUS AND KIT FOR SUPPORTING INCLINED STRUCTURES

The present invention is a continuation-in-part application of U.S. patent application Ser. No. 13/030,181, entitled "Apparatus and Kit for Supporting Inclined Structures," filed Feb. 18, 2011, the entirety of which is expressly incorporated herein.

TECHNICAL FIELD

The present invention relates to an apparatus and kit for use in supporting inclined objects and structures. Specifically, the present invention relates to an apparatus and kit useful for extending platforms on a roof in which scaffolding can be built upon. More specifically, the apparatus relates to an interconnected anchoring section designed to support the weight of equipment and individuals working on an inclined surface. The apparatus includes, generally, an anchoring section to attach to the peak of a rooftop or other inclined surface, and an attaching surface to connect the anchoring section to the platform section. The platform section allows equipment to be built thereon without damaging the roof or surface beneath.

BACKGROUND

It is, of course, generally known to maintain or repair structures. Buildings and edifices are constructed with longevity in mind; however, time, weathering, and damage can shorten their lifetimes. As a structure becomes damaged, the integrity of their support structure begins to falter. This necessitates maintenance or repairs in order to continue the longevity of the building's lifetime.

Generally, maintenance or repairs made on an edifice are restricted by the height and reach of the individual repairing the building. For structures that have more than one story, repairs to the higher levels cannot be completed without specialized equipment. One example in this specialization is the ladder. A ladder is a vertical, inclined, or horizontal set of steps that allows individuals to reach heights or distances that were previously restricted. Ladders come in many shapes and forms; many are made of rigid materials, while some may be made of rope. Usually fixed ladders, extension ladders, step ladders, and roof ladders are used in maintenance or repair of buildings and edifices.

Normally, safety is a concern when using a ladder in repairs. When leaning a ladder against an edifice, the angle from the vertical must be large enough to prevent the ladder from falling backwards but small enough to prevent the ladder from falling forwards. The composition of a ladder is a safety concern as well. A ladder must be constructed in such a way to support an angled weight over a distance. As the heights of buildings grow, so do these distances. There is a restricting point, however, when the building height is much too large for a ladder to be used and still be structurally stable. This is because a ladder's support comes only from two locations: the ground the ladder is on and the edifice the ladder is leaning against.

A more improved embodiment of this specialization is a scaffold. A scaffold is a temporary constructed structure made of an arrangement of pipes, tubes, and clamps in the form of a rectangular prism. These pipes and tubes are usually made of sturdy metals such as steel, but can also be made of other forms of sturdy materials such as wood or bamboo.

When built correctly, a system of scaffolds, also known as scaffolding, can be built to extend the entirety of a building, much further than a ladder.

Rarely does scaffolding stand on its own. In order to make more stable, scaffolding is generally fixed to the building. This stabilizes the scaffolding to a fixed structure, adding to the already stable rectangular prism configuration. This is a necessity for larger scaffolding because of the effects of wind, swaying, and shifting of weight. Scaffolding is fixed to a structure commonly by using anchor ties, which are fixed into holes that may be drilled directly into a building. This may cause unnecessary damage to the building or other structure.

Generally, a good foundation is needed for scaffolding to be built upon. A flat surface that can spread the weight of the load evenly may help to make a scaffold stable. In cases where scaffolding is needed to be built on an inclined surface, angled brackets may be used to attach to the flat inclined surface while allowing the scaffold to stand vertically. In cases where scaffolding is needed to be built on a rough surface, a flat base plate may be used in lieu of the surface.

A roof is the upper most part of a building that protects the contents of an edifice from the effects of weather. One embodiment of a roof is a flat surface. The flat surface does not distribute rainfall or snowfall very well as much of the rain, snow or ice generally stays in the same place it falls. Constant build-up of rain, snow or ice on a flat surface can lead to damage such as weakening of the surface or percolations in the surface. A more improved embodiment is an inclined roof. An incline distributes rain or snow very well, allowing the rain or snow to descend down the incline and off of the roof itself, preventing damage. Any damage to a roof, whether from rain, snow, ice or other causes, can cause imperfections in the protection of the internal contents of an edifice.

Generally, the structure of an inclined roof is based on an A-Frame. The simplest form is created by two beams or rafters, generally angled at forty five degrees or greater, connected together at the peak. A support beam is connected between the two beams, creating a structure similar to the letter "A." This support system is then covered by an outer layer, commonly made of asphalt shingles. These are placed on top of each other, overlapping so that rain, snow or ice may flow over them without percolating through them. Damage to this outer surface, can cause weather, which would otherwise not enter the internal cavities of a building, to penetrate and damage the internal contents of an edifice.

It is, of course, generally known to maintain or repair the roofing of structures. Roofing is constructed with longevity in mind. However, time, weathering, and damage can shorten its lifetime. As a roof becomes damaged, its protection begins to falter. This necessitates maintenance or repairs in order to continue the longevity of the roof's lifetime.

Generally, repairs to a roof are restricted by an individual's comfortability. On an inclined surface, such as a roof, force is not distributed the same as on a flat surface. A force is any influence that causes a body to change speed, direction, or shape. The weight or force of an object is directly downwards, however, there are also forces perpendicular and parallel to an inclined surface. The forces perpendicular to an inclined surface prevent an individual from falling through that surface. The forces parallel to the inclined surface act on an object and can cause the object to progress down that incline. These forces can cause an object to slide, tip over, or possibly fall. When that object is a person and the inclined surface is a roof 10-20 feet above the ground, the possibilities of injury to that person are great and severe.

Normally, an individual anchors oneself to a fixture on a roof or inclined surface as a cautionary measure to prevent oneself from losing balance and falling. Specifically, one may also anchor a piece of equipment such as a ladder that would aid in the repairing of a roofing structure. Devices such as these are beneficial in conducting repairs and resisting parallel forces of an incline; however, these devices can damage the inclined surface on which they are positioned. Ladders also keep an individual on the inclined plane such that their bodies are still encumbered by the parallel forces of an incline, even though the ladder itself resists those forces.

Erecting scaffolding on a roof has the advantage of allowing an individual to remain under the normal forces of gravity during work. Anchoring scaffolding in such a way that the parallel forces of an incline are resisted, while allowing an individual to work without the same parallel forces upon them is extremely beneficial.

Generally, scaffolding is attached to a roof or other inclined surface directly, in order to anchor the scaffold to a roof and resist the parallel forces of an incline. This is normally done by using anchor ties, which are fixed into holes drilled directly into a roof or other incline. This may cause unnecessary damage to the roof or inclined surface, which could cause weather percolation and unnecessary damage to the internal contents of the edifice.

A need, therefore, exists for an apparatus and kit for repairing damaged structures on inclined surfaces without damaging the surfaces in the process. Specifically, a need exists to repair structures on a roof without causing damage to the roof.

Moreover, a need exists for an apparatus and kit that can support the weight of workers and their equipment without causing damage to the underlying surface.

Further, a need exists for an apparatus and kit that would allow scaffolding to be built upon it so that necessary repairs can be accomplished without causing damage to the underlying surface.

Also, a need exists for an apparatus and kit that would provide a good foundation, spreading the load of the scaffolding equally and effectively. Particularly, a need exists for a sturdy platform section for mounting the scaffolding thereon.

And, a need exists for an apparatus and kit that can fix the scaffolding structure to a building without damaging the building in the process.

Moreover, a need exists for an apparatus and kit that can resist the parallel forces that cause an object on an inclined surface to slide, tip over, or fall.

Further, a need exists for an apparatus and kit that would allow an individual to tether to an inclined surface. Specifically, a need exists for an apparatus that allows an individual to safely move about an inclined surface and prevent the individual from falling from the same.

Finally, a need exists for an apparatus and kit allowing the support of the weight of workers, their equipment, and scaffolding while resisting the parallel forces due to an inclined surface and without damaging the underlying inclined surface.

SUMMARY OF THE INVENTION

The present invention relates to an apparatus and kit for use in supporting inclined objects and structures. Specifically, the present invention relates to an apparatus and kit useful for extending platforms on a roof in which scaffolding can be built upon. More specifically, the apparatus relates to an interconnected anchoring section designed to support the weight of equipment and individuals working on an inclined surface. The apparatus includes, generally, an anchoring section to attach to the peak of a rooftop or other inclined surface, and an attaching surface to connect the anchoring section to the platform section. The platform section allows equipment to be built thereon without damaging the roof or surface beneath.

To this end, in an embodiment of the present invention, an apparatus for anchoring a platform on an incline is provided. The apparatus comprises a main body portion having a first end, a second end, and a length between the first end and the second end; an anchoring section for securing the apparatus near the peak of an inclined surface, the anchoring section disposed at the first end of the main body portion; an attaching surface for securing a platform on the underside of the apparatus, the attaching surface disposed at the second end of the main body portion; and a bend in the length between the anchoring section and attaching surface.

In an embodiment, the apparatus further comprises an abutting element disposed on the underside of the attaching surface extending away from the underside of the attaching surface.

In an embodiment, the abutting element is an "L"-shaped bar.

In an embodiment, the anchoring section comprises an extension selected from a group consisting of a "J"-shaped bar, a cylindrical pipe, a contact edge, and any combination thereof.

In an embodiment, the bend in the length between the anchoring section and the attaching surface is selected from a group consisting of an arcuate section, an elbow, a plurality of bends, and any combination thereof.

In an embodiment, the attaching surface comprises of a coupling selected from a group consisting of bolts, screws, adhesives, nails, rivets, staples, and any combination thereof.

In an alternate embodiment of the present invention, a kit for anchoring and attaching scaffolding on an incline is provided. The kit comprises an apparatus comprising a main body portion having an anchoring section on a first end, an attaching surface on a second end, and a bend in the length between the first end and the second end; and a platform surface comprising a main body portion having a length, a first end and a second end and a base connector for receiving a scaffold pipe, the base connector disposed between the first end and the second end of the main body portion.

In an embodiment, the apparatus is connected to a platform surface via a coupling selected from a group consisting of bolts, screws, adhesives, nails, rivets, staples, and any combination thereof.

In an embodiment, the kit further comprises a second apparatus comprising a main body portion having an anchoring section on a first end, an attaching surface on a second end, and a bend in the length between the first end and the second end; and a second platform surface comprising a main body portion having a length, a first end and a second end and a base connector for receiving a scaffold pipe, the base connector disposed between the first end and the second end of the main body portion.

In an embodiment, the first apparatus is connected to the first platform surface and the second apparatus is connected to the second platform surface via a coupling selected from a group consisting of bolts, screws, adhesives, nails, rivets, staples, and any combination thereof.

In an embodiment, the kit is assembled on an incline with a length between the first and second platforms and the first and second platforms are assembled in parallel.

In an embodiment, scaffolding is assembled spanning the length between the first and second platforms.

In an alternate embodiment of the present invention, an apparatus for anchoring a platform on an incline is provided. The apparatus comprises a first portion having a main body portion having a first end, a second end, and a length between the first end and the second end; a first portion having an anchoring section for securing the apparatus near the peak of an inclined surface, the anchoring section disposed at the first end of the main body portion; a first portion having an attaching surface for securing a platform to the apparatus, the attaching surface disposed at the second end of the main body portion; a first portion having a bend in the length between the anchoring section and attaching surface; a second portion having a main body portion having a first end, a second end, and a length between the first end and the second end; a second portion having an anchoring section for securing the apparatus near the peak of an inclined surface, the anchoring section disposed at the first end of the main body portion; a second portion having an attaching surface for securing a platform to the apparatus, the attaching surface disposed at the second end of the main body portion; a second portion having a bend in the length between the anchoring section and attaching surface; and a length between the first and second portions.

In an embodiment, the apparatus further comprises an abutting element disposed on the underside of the attaching surfaces of the first and second portions, spanning the length between the first and second portions, connecting together the first and second portions, extending away from the underside of the attaching surfaces.

In an embodiment, the abutting element is an "L"-shaped bar.

In an embodiment, the apparatus further comprises a supportive brace spanning the length between the first and second portions, connecting together the first and second portion.

In an embodiment, on at least one of the first and second portions, the anchoring section comprises an extension selected from a group consisting of a "J"-shaped bar, a cylindrical pipe, a contact edge, and any combination thereof.

In an embodiment, the extensions of the first and second portions form a union.

In an embodiment, on at least one of the first and second portions, the bend in the length between the anchoring section and the attaching surface is selected from a group consisting of an arcuate section, an elbow, a plurality of bends, and any combination thereof.

In an embodiment, on at least one of the first and second portions, the attaching surface comprises of a coupling selected from a group consisting of bolts, screws, adhesives, nails, rivets, staples, and any combination thereof.

It is, therefore, and advantage of the present invention to provide an apparatus and kit for repairing damaged structures on inclined surfaces without damaging the surfaces in the process. Specifically, it is an advantage of the present invention to repair structures on a roof without causing damage to the roof.

Moreover, it is an advantage of the present invention to provide an apparatus and kit that can support the weight of workers and their equipment without causing damage to the underlying surface.

Further, it is an advantage of the present invention to provide an apparatus and kit that would allow scaffolding to be built upon it so that necessary repairs can be accomplished without causing damage to the underlying surface.

Also, it is an advantage of the present invention to provide an apparatus and kit that would provide a good foundation, spreading the load of the scaffolding equally and effectively. Particularly, it is an advantage of the present invention to provide a sturdy platform section for mounting the scaffolding thereon.

And, it is an advantage of the present invention to provide an apparatus and kit that can fix the scaffolding structure to a building without damaging the building in the process.

Moreover, it is an advantage of the present invention to provide an apparatus and kit that can resist the parallel forces that cause an object on an inclined surface to slide, tip over, or fall.

Further, it is an advantage of the present invention to provide an apparatus and kit that would allow an individual to tether to an inclined surface. Specifically, it is an advantage of the present invention to provide an apparatus that allows an individual to safely move about an inclined surface and prevent the individual from falling from the same.

Finally, it is an advantage of the present invention to provide an apparatus and kit allowing the support of the weight of workers, their equipment, and scaffolding while resisting the parallel forces due to an inclined surface and without damaging the underlying inclined surface.

Additional features and advantages of the present invention are described in, and will be apparent from, the detailed description of the presently preferred embodiments and from the drawings.

BRIEF DESCRIPTION OF THE DRAWINGS

The drawing figures depict one or more implementations in accord with the present embodiments, by way of example only, not by way of limitations. In the figures, like reference numerals refer to the same or similar elements.

DETAILED DESCRIPTION OF THE PRESENTLY PREFERRED EMBODIMENTS

The present invention relates to an apparatus and kit for use in supporting inclined structures. Specifically, the present invention relates to an apparatus and kit useful for extending platforms on a roof in which scaffolding can be built upon. More specifically, the apparatus relates to an interconnected anchoring section designed to support the weight of equipment and individuals working on an inclined surface. The apparatus includes, generally, an anchoring section to attach to the peak of a rooftop or other inclined surface, and an attaching surface to connect the anchoring section to the platform section. The platform section allows equipment to be built thereon without damaging the roof or surface beneath.

Although the present invention is described in relation to building scaffolding and repairing structures on an inclined roofing surface, it should be apparent to one of ordinary skill in the art that the components of the present invention, as described in the embodiments presented herein, may be useful for building or repairs on similar inclined surfaces.

Figure 1:
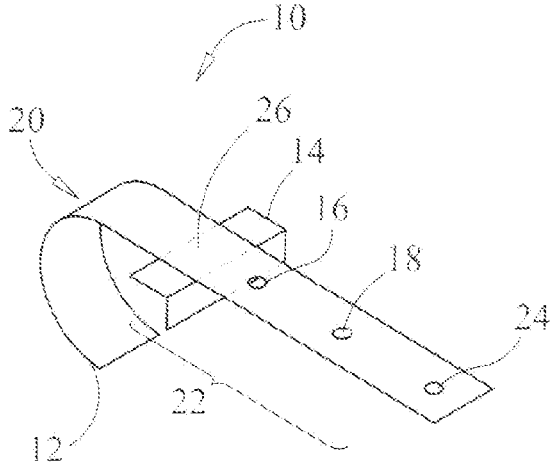
FIG. 1 illustrates a perspective view of an apparatus in an embodiment of the present invention.

Now referring to the figures, wherein like numerals refer to like parts, an apparatus 10 of the present invention is provided in FIG. 1. The apparatus 10 includes an anchoring section 12 and an attaching surface 22 interconnected together to form an embodiment of the present invention. The anchoring section 12 may be integrally formed together with the attaching surface 22 allowing for maximum strength of apparatus 10. Specifically, the apparatus 10 may be made from a strong metal such as steel or another material apparent to one having ordinary skill in the art to provide the apparatus 10 with a large weight capacity. The anchoring section 12 may be interconnected to the attaching surface 22 via an arcuate segment 20 in order to anchor the apparatus 10 to the peak of an inclined surface.

As shown in FIG. 1, the apparatus 10 may contain an abutting element 14. The abutting element 14 may be an "L"-shaped bar made out of a strong metal or another material known to one skilled in the art that may align a platform in place while the attaching surface 22 may be connected to the platform. Further, the abutting element 14 may be welded or otherwise attached beneath the attaching surface 22 at location 26. The attaching surface 22 may have a plurality of fastening holes 16, 18, 24 to connect the attaching surface 22 to a platform, such as a plank, as described below. Of course, any number of fastening holes may be provided, and the present invention should not be limited as described herein.

Moreover, as shown in FIG. 1, the anchoring section 12 may be comprised of a strong metal or another material known to those skilled in the art that would fix, or otherwise anchor, the anchoring section 12 to the peak (or in close proximity thereto) of an inclined surface, such as a roof on a building, without damaging the inclined surface itself, as described in further detail below.

Figure 2A:
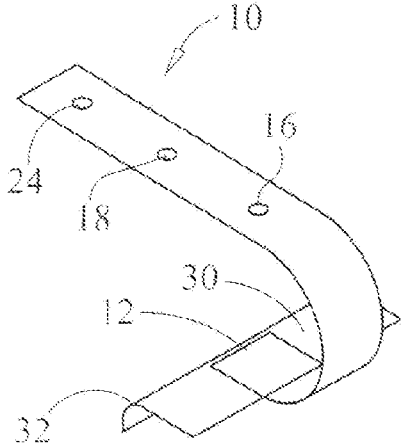
FIG. 2A illustrates a perspective view of an anchoring section in a preferred embodiment of the present invention.

As shown in FIG. 2A, an embodiment of an apparatus 10 with an anchoring section 12 and fastening holes 16, 18, 24 is shown. The anchoring section 12 is connected to a preferred "J"-shaped bar extension 30. The "J"-shaped bar extension 30 may be made of a strong metal or another material known to those skilled in the art, curved parabolically at a contact point 32, allowing for contact to be made at or near the peak of an inclined surface thereby inflicting minimal damage to the peak or the supporting inclined surface.

Figure 2B:
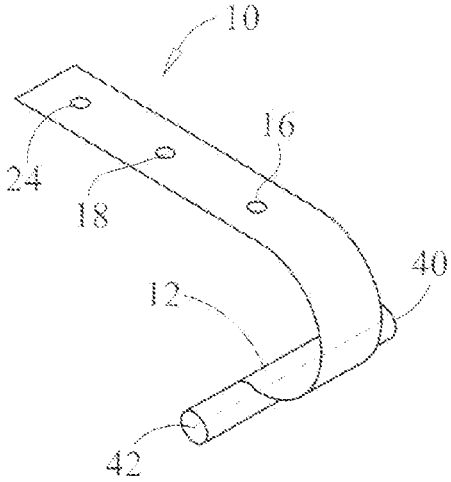
FIG. 2B illustrates a perspective view of an anchoring section in an alternate embodiment of the present invention.

As shown in FIG. 2B, an alternate embodiment of an apparatus 10 with an anchoring section 12 and fastening holes 16, 18, 24 is shown. The anchoring section 12 is connected to a cylindrical pipe extension 40. The cylindrical pipe extension 40 may be made of a strong metal or another material known to those skilled in the art, curved generally circularly at a contact point 42, allowing for contact to be made with the peak of an inclined surface and with minimal damage inflicted. It should be noted that any cross-section for the cylindrical pipe extension 40 may be utilized, such as oval, square, rectangular, triangular, or any other shape for anchoring the anchoring section 12 at or near the peak of a roof or other incline without damaging the peak or supporting surface thereof.

Figure 2C:
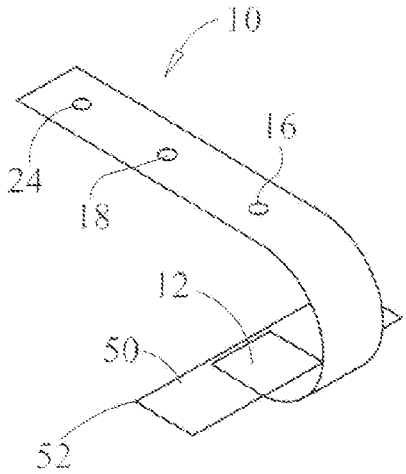
FIG. 2C illustrates a perspective view of an anchoring section in an alternate embodiment of the present invention.

As shown in FIG. 2C, an alternate embodiment of an apparatus 10 with an anchoring section 12 is shown. The anchoring section 12 may connect to a rectangular bar 50. The rectangular bar 50 may be made of a strong metal or another material known to those skilled in the art, terminating at a contact point 52. The rectangular bar 50 may allow for a precise and sturdy anchoring of the anchoring section 12 and the apparatus 10 at a contact point 52.

Figure 3:
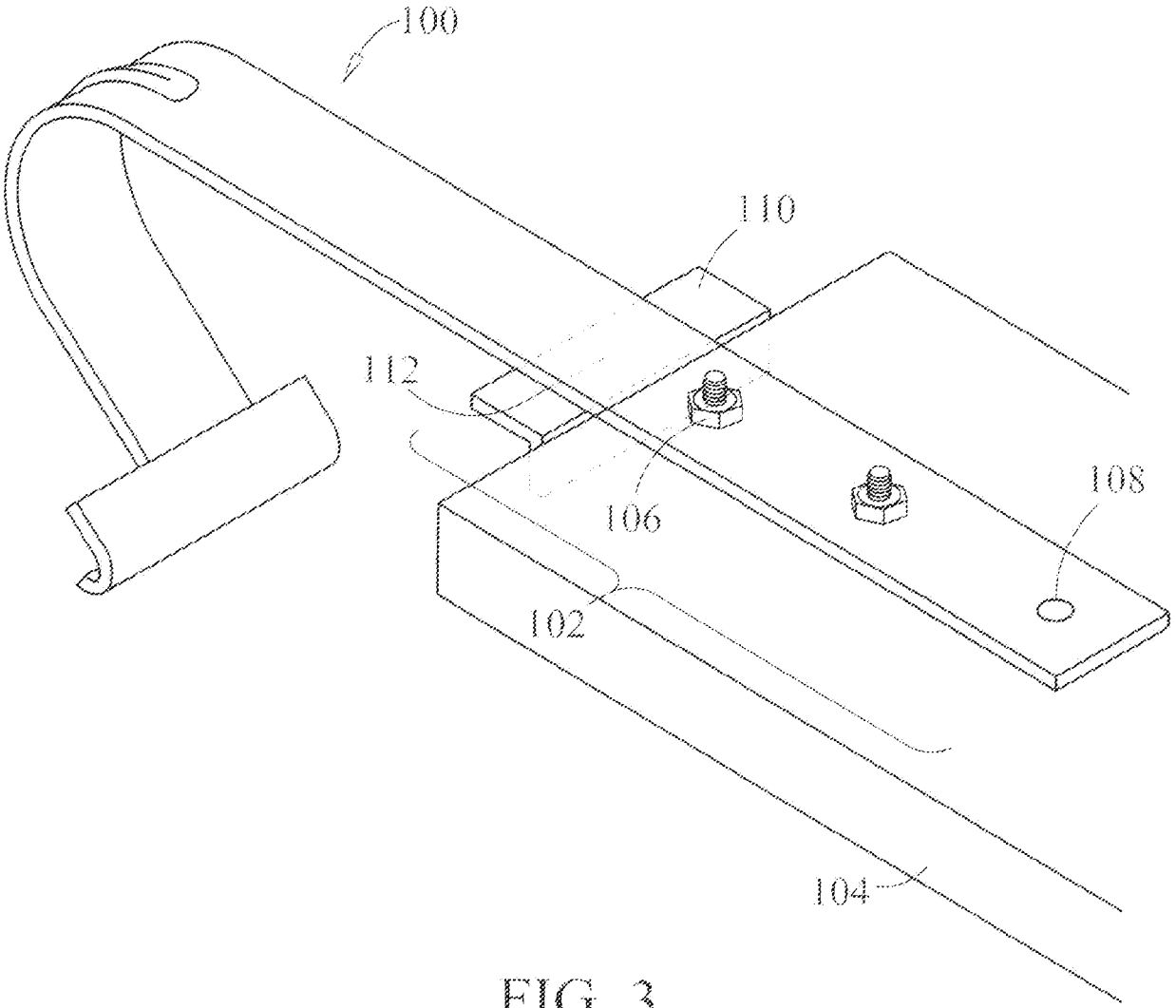
FIG. 3 illustrates a perspective view of an apparatus attached to a platform section in a preferred embodiment of the present invention.

As shown in FIG. 3, an apparatus 100 is shown and described. The apparatus 100 may be connected via an attaching surface 102 to a platform section 104. The platform section 104 may be attached or otherwise connected to the attaching surface 102 by one or more securing bolts 106 disposed through one or more fastening holes 108 disposed within the attaching surface 102. The securing bolts 106 may be made out of a strong metal or another material known to those skilled in the art that would firmly and effectively attach or connect the apparatus 100 to the platform section 104 via the attaching surface 102.

As shown in FIG. 3, the apparatus 100 may include an abutting element 110. The abutting element 110 may be an "L"-shaped bar made out of a strong metal or another material known to one skilled in the art that may brace a platform in place while the attaching surface 102 may be connected to the platform section 104. Further, the abutting element 110 may be welded or otherwise attached beneath the attaching surface 102 at location 112. Specifically, the abutting element may allow precise placement of the apparatus 100 for attaching to a plank, such that the anchoring section, as described herein, may be properly positioned to anchor the apparatus and, hence, the platform, at or near the peak of a roof.

The platform section 104 may be made of wood or another material known to those skilled in the art that would allow for components to be attached to it. In a preferred embodiment, the platform section 104 may be a plank that may lay flat upon an inclined surface and may be useful for erecting a supporting structure thereon, as described in more detail below.

Figure 4:
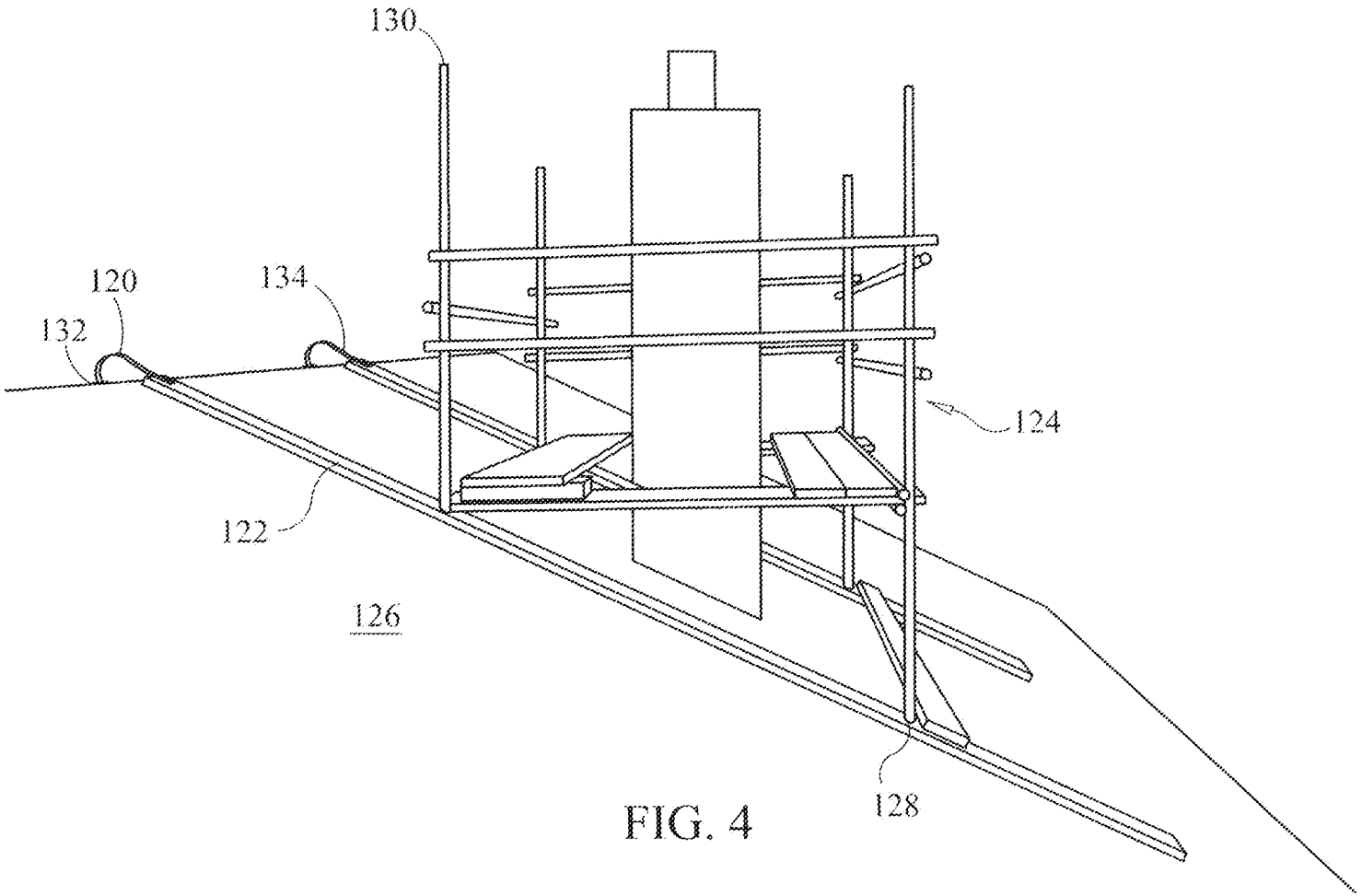
FIG. 4 illustrates a perspective view of an apparatus, a platform section, and scaffolding used as a kit for conducting repairs on a roof in a preferred embodiment of the present invention.

As shown in FIG. 4, an apparatus 120 is shown and described in an embodiment of the present invention. The apparatus 120 may be used with a platform section 122 for the building of scaffolding 124 on a rooftop 126 or other inclined surface. The scaffolding 124 may be connected to the platform section 122 via one or more base connectors 128. The base connectors 128 may be angled as necessary in order to dispose scaffolding pipe 130 generally perpendicular to the ground. By situating the scaffolding pipe 130 perpendicular to the ground, the scaffolding 124 may allow an individual to stand thereon, under the normal forces of gravity. Once an individual is allowed to stand perpendicular to the ground, the parallel forces along the incline are removed from that individual allowing the individual to effectively work on the scaffolding 124. The parallel forces may then be borne by the apparatus 120. These parallel forces are resisted, however, by the anchoring section 132, attached or otherwise anchored at or near the peak of the rooftop 126 or other incline, as illustrated in FIG. 4.

As shown in FIG. 4, a parallel apparatus 134 is shown and described in an embodiment of the present invention. The parallel apparatus 134 may be used similarly and in addition to apparatus 120 in order to construct scaffolding 124 in a rigid rectangular prism form. Any number of apparatuses, as described herein, may be utilized to anchor platform sections, such as planks, for the building of scaffolding thereon, or for any other purpose, to allow the platform section to lay flat upon the inclined surface of the roof or other incline and be anchored thereon without damage to the roof or other incline.

Figure 5:
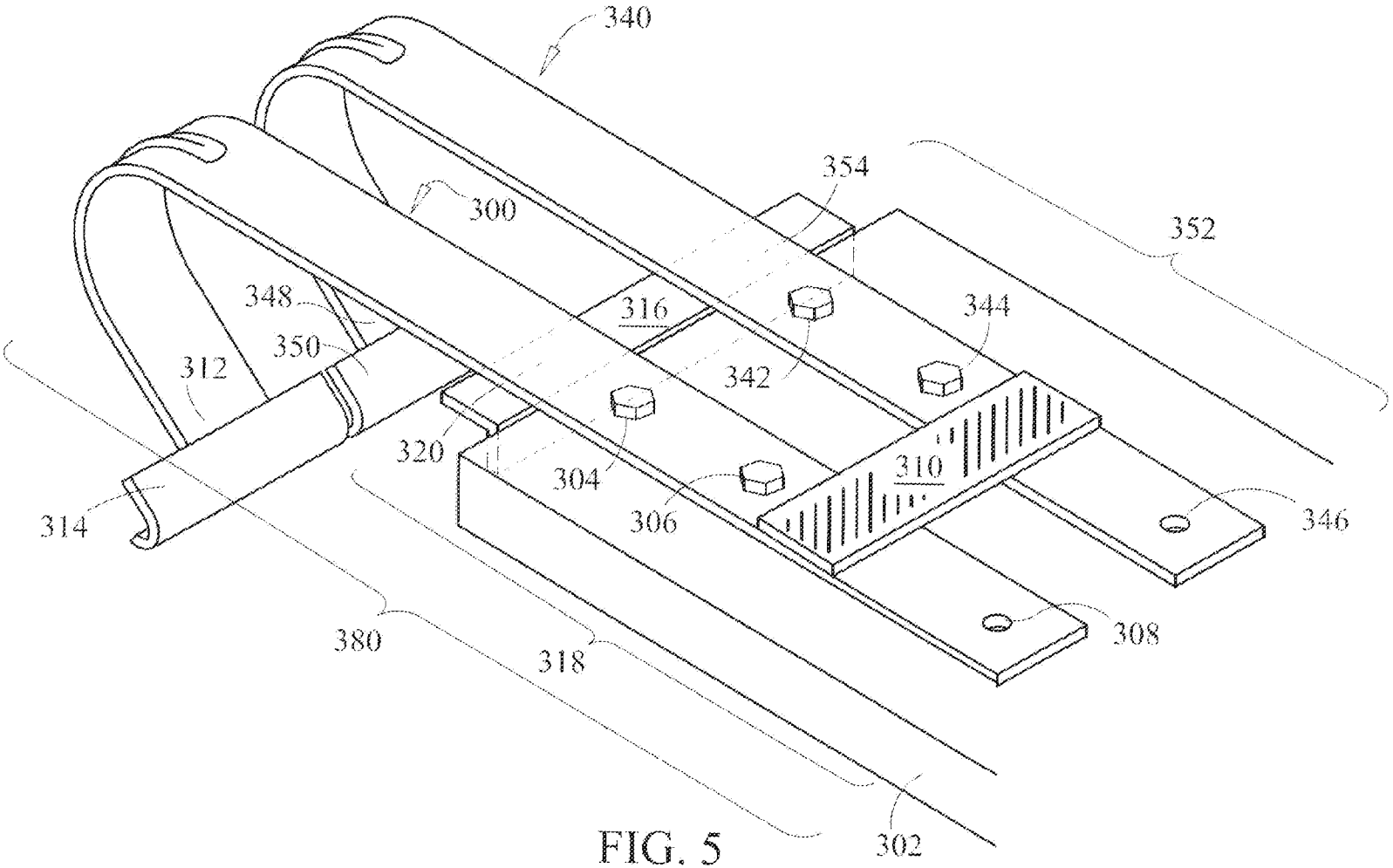
FIG. 5 illustrates a perspective view of a plurality of apparatuses connected together in parallel in a preferred embodiment of the present invention.

As shown in FIG. 5, an apparatus 380 with a plurality of apparatus sections 300, 340 is shown and described in a preferred embodiment of the present invention. The apparatus sections 300, 340 may be integrally connected to a platform section 302 via bolts 304, 306, 342, 344, inserted into a plurality of fastening holes, examples of which are shown as 308, 346. Of course, any number of fastening holes may be provided in apparatus sections 300, 340. Further, the apparatus sections 300, 340 may be secured together by a supportive brace 310, welded or otherwise attached to both the apparatus sections 300, 340 that may hold the apparatus sections 300, 340 together as a single solid piece. This supportive brace 310 may be made out of a strong metal or another material known to those skilled in the art that would aid in holding the apparatus sections 300, 340 together to form the apparatus 380.

Still referring to FIG. 5, the apparatus 380 with the plurality of apparatus sections 300, 340 may have a plurality of anchoring sections 312, 348 as shown and described in a preferred embodiment of the present invention. The anchoring sections 312, 348 may preferably be connected to a plurality of "J"-shaped bar extensions 314, 350. The "J"-shaped bar extensions 314, 350 may be separate extensions, as shown in FIG. 5, or may be a single extension, welded together, or otherwise attached together in order to solidify the apparatus sections 300, 340 together. However, the anchoring sections may be of any shape, as described above with respect to FIGS. 2A-2C, or any other shape to anchor the apparatus at or near a peak.

As shown in FIG. 5, the apparatus 380 may include an abutting element 316. The abutting element 316 may be an "L"-shaped bar for allowing the platform section 302 to be butted up against it before connecting the attaching surfaces 318, 352 to the platform section 302. The abutting element 316 may be a single element, as shown in FIG. 5, or may be separate elements, each attached to one of the apparatus sections 300, 340. Further, the abutting element 316 may be welded or otherwise attached integrally to apparatus sections 300, 340 beneath the attaching surfaces 318, 352 at locations 320, 354. The abutting element 316 may be made out of a strong metal or another material known to those skilled in the art that would aid in solidifying the apparatus sections 300, 340 together.

As shown in FIG. 5, the platform section 302 is shown and described in a preferred embodiment of the present invention. The platform section 302 may be made of wood or another material known to those skilled in the art that would allow for components to be attached to it. In a preferred embodiment, the platform section 302 may be a plank that may be useful for erecting a supporting structure thereon, as described in detail above.

Figure 6:
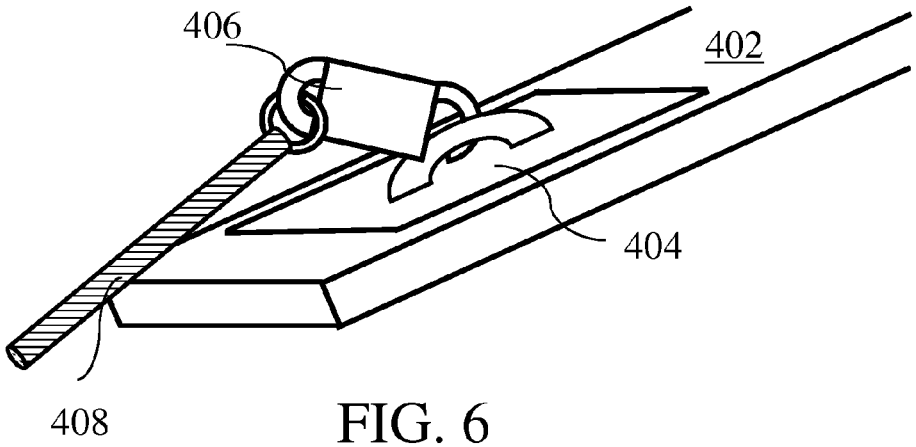
FIG. 6 illustrates a perspective view of a platform section and a tethering device in an embodiment of the present invention.

As shown in FIG. 6, a platform section 402 is shown and described in an alternate embodiment of the present invention. The platform section 402 may be made of wood or another material known to those skilled in the art that would allow for components to be attached to it. A connector or latching plate 404 may be disposed at one end of the platform section 402. The connector or latching plate 404 may be bolted to the platform section 402 using bolts, screws, rivets, or any other connecting means apparent to one of ordinary skill in the art, and may include a U-shaped connector attached thereto for connecting to a hooking device 406, as described below.

The connector or latching plate 404 may allow the hooking device 406 to attach thereto. The hooking device 406 may be used to secure an individual to the platform section 402. Specifically, an individual may attach to the platform section 402 with a tether 408, which may be attached to hooking device 406. The platform section 402 may be set or otherwise disposed on an inclined surface, such as a roofline, and may secure the individual to the inclined surface via the tether 408. The tether 408 may be of any length such that an individual may freely move about an inclined surface; however, the tether 408 may balance or otherwise prevent an individual from falling from the inclined surface. The tether 408 and the hooking device 406 may have a large weight tolerance such that it would support the weight of an individual or other object as the individual moves about the inclined surface.

Figure 7:
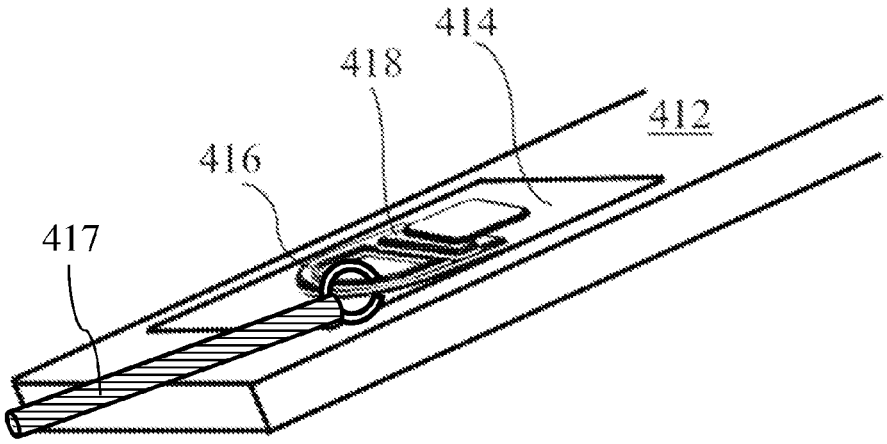
FIG. 7 illustrates a perspective view of a platform section and a D-Ring connector in an embodiment of the present invention.

FIG. 7 illustrates an alternate embodiment of the present invention of a platform section 412 having a connector or latching plate 414 disposed thereon. The connector or latching plate 414 may be bolted to the platform section 412 using bolts, screws, rivets, or any other connecting means apparent to one of ordinary skill in the art. Connecter to the connector or latching plate 414 may be a D-Ring 416 that may be connected via a hinged mechanism 418. A tether 417 may be tied or otherwise connected to the D-Ring 416 to secure an individual or other object when disposed on an inclined surface.

Figure 8:
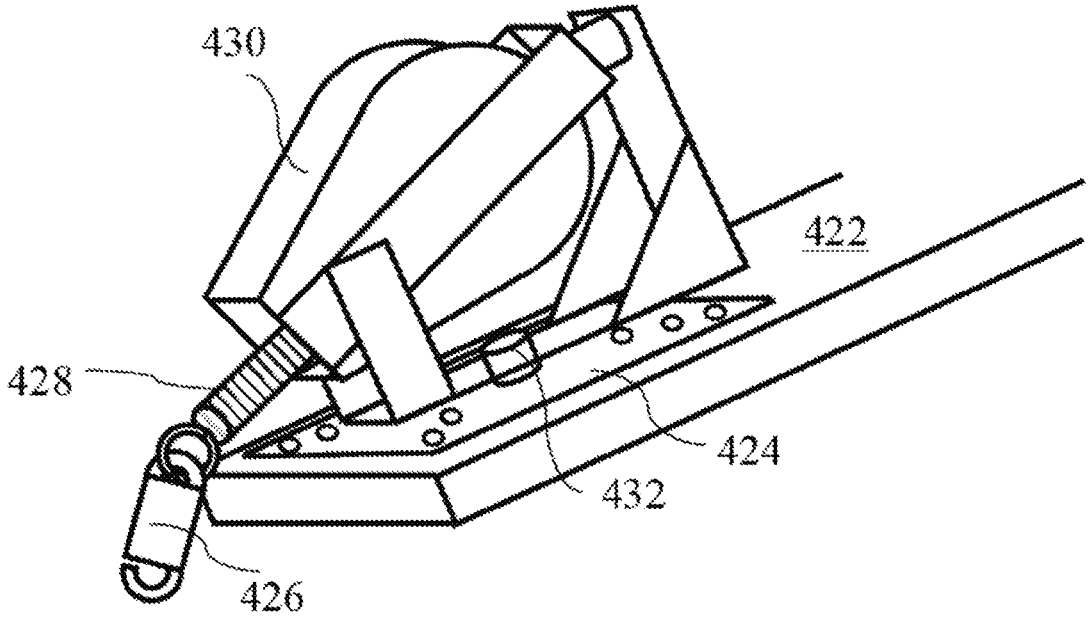
FIG. 8 illustrates a perspective view of a platform section and a retractable tethering device in a preferred embodiment of the present invention.

As shown in FIG. 8, a platform section 422 is shown and described in an alternate embodiment of the present invention. A connector or latching plate 424 may be disposed at one end of the platform section 422. The connector or latching plate 424 may allow a retractable tethering device 430 to attach to the platform section 422. The retractable tethering device 430 may allow a tether 428 and a hooking device 426 to extend a length and retract. Specifically, the retractable tethering device 430 may contain a quantity of tether 428 (or rope, or other like material) coiled therein to conserve space. The tether 428 may be pulled and uncoiled from the retractable tethering device 430 to a predetermined length. The tether 428 may retract into the retractable tethering device 430 and re-coil automatically.

Pulling the tether 428 at a high velocity may simulate a fall from the inclined surface. The retractable tethering device 430 may prevent the tether 428 from extending when the tether 428 is pulled at a high velocity in order to prevent one from falling. Alternatively, the retractable tethering device 430 may simply be set to play out the tether to a maximum length thereby stopping an individual from falling from a height, such as a roof on a building. The retractable tethering device 430 may rotate about an axel 432. The axel 432 may allow the retractable tethering device 430 to rotate 360 degrees and may allow an individual to move freely about an inclined surface.

The hooking device 426 may allow an individual to attach to the tether 428 and the retractable tethering device 430. A safety harness (not shown) may wrap around an individual and connect or otherwise attach to the hooking device 426. An individual may use the retractable tethering device 430 to anchor or otherwise safely secure to an inclined surface without losing balance or maneuverability.

Figure 9:
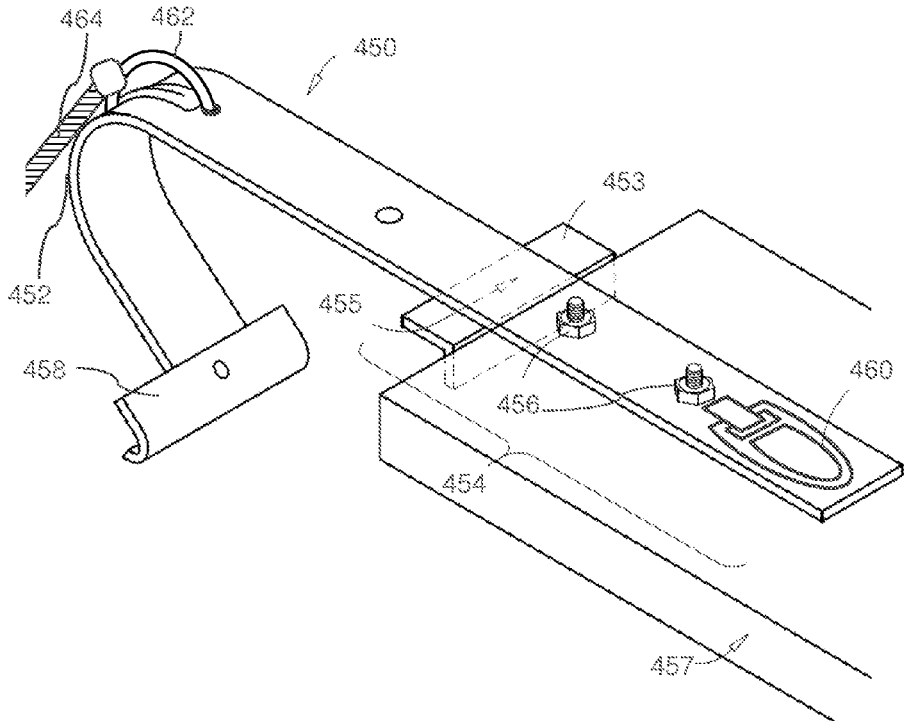
FIG. 9 illustrates a perspective view of an anchoring apparatus, including a stabilizing ring and a tether connector in an embodiment of the present invention.

FIG. 9 illustrates an alternate embodiment of the present invention of an anchoring apparatus 450. The anchoring apparatus 450 may include an arcuate portion 452 and a straightened portion 454 that may be bolted to a platform section 457 via bolts 456. The anchoring apparatus 450 may include an anchor portion 458 that may be disposed on an incline to anchor the anchoring apparatus 450, as described above. Moreover, as described above, the straightened portion 454 may have a cross-piece 453 adhered or otherwise connected on the bottom of the straightened portion 454, and may be welded thereto via weld 455 or any other adherent apparent to one of ordinary skill in the art. The cross-piece 453 may act as a guide for disposing the platform section 457 thereto.

A tether connector 460 may be disposed on the straightened portion 454 for connecting to a tether or other line for securing an individual or other object thereto. The tether connector 460 may preferably be a D-Ring connector, as shown in FIG. 9, although the connector may be any connector that allows a tether or other securing line to connect thereto and secure an individual that may be working on an inclined surface, such as a roof.

Disposed on or near the arcuate portion 452 may be a securing ring 462 that may allow securing a securing line 464 thereto for stabilizing the anchoring apparatus 450 from moving when disposed on an inclined surface at or near the peak of a roof. Alternatively, a plurality of securing lines may be utilized to anchor or otherwise tie down the anchoring apparatus 450. Moreover, the securing line 464 may be a rope, wire, cable, tether, or other like securing line. Specifically, the securing line 464 may be connected to the securing ring 462, which may generally consist of an arcuate piece of metal or other like material that may be well adhered or integrally connected to the anchoring apparatus 450. For example, the securing ring 462 may be made of metal and welded to the anchoring apparatus 450 in the vicinity of the arcuate portion 452 of the anchoring apparatus.

The securing line 464 may be utilized to secure the anchoring apparatus, minimizing or preventing the movement of the anchoring apparatus 450, providing additional security thereto. Specifically, the securing line 464 may be tied to securing objects such as roof structures, to nearby trees and/or shrubs, to anchors that may be hooked into eaves of the house or other ground, or any other securing mechanism apparent to one of ordinary skill in the art.

Figure 10:
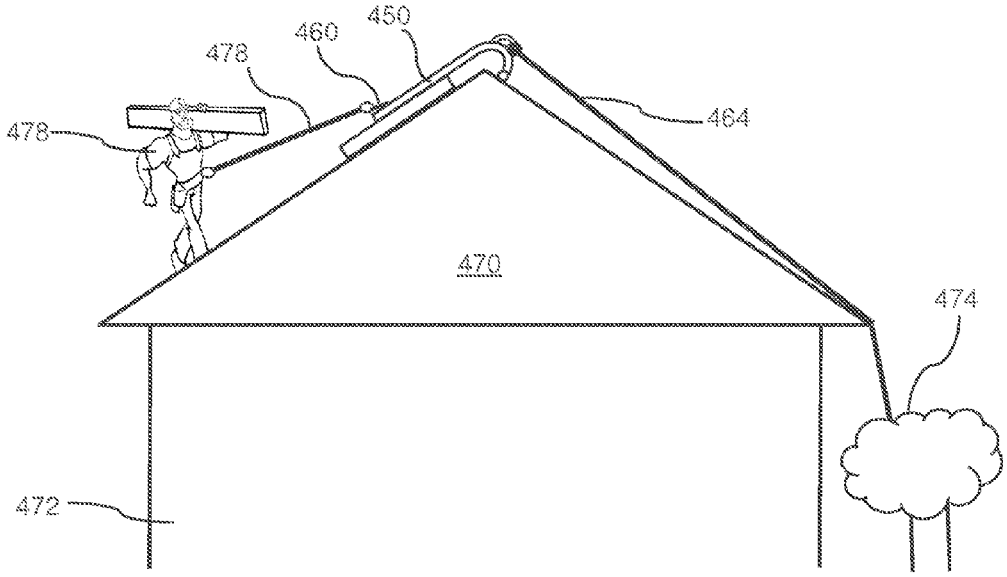
FIG. 10 illustrates a side view of an anchoring apparatus with a platform section disposed on an incline and stabilized with an anchoring tether in an embodiment of the present invention.

In an exemplary embodiment of the present invention, FIG. 10 illustrates the anchoring apparatus 450 disposed on a roof 470 of a house 472. The securing line 464 may extend from the securing ring 462 away from the anchoring apparatus 450 to secure to a stationary object or other anchoring means, such as a tree 474, for example.

Moreover, as shown in FIG. 10, the anchoring apparatus 450 may include the connector 460, such as a D-ring connector, for tying or otherwise connecting a tether or securing line 476 thereto, the other end thereof connected to an individual 478 or other object (not shown) for securing the same on the inclined surface of the roof 470. Thus, the individual 478 may be secured from falling and/or injuring him or herself when moving on an inclined surface while maintaining a high degree of freedom as he or she moves about on the inclined surface.

It should be noted that various changes and modifications to the presently preferred embodiments described herein will be apparent to those skilled in the art. Such changes and modifications may be made without departing from the spirit and scope of the present invention and without diminishing its attendant advantages.

I claim:

1. A method of tethering an individual to an inclined surface having a first side, a second side, a border, and a peak between the first side and the second side, the method comprising:

providing an attaching apparatus comprising a main body portion having a length, an anchoring section on a first end for attaching near the peak of the inclined surface, an attaching surface on a second end, and a bend in the length between the first end and the second end, wherein the anchoring section is disposed on the first side of the inclined surface and the attaching surface is disposed in proximity to the second side of the inclined surface when the apparatus is disposed on the inclined surface; a platform section comprising a main body portion having a length, a first end and a second end, wherein the platform section lies flat against the second side of the inclined surface between the attaching surface and the second side of the inclined surface when the apparatus is disposed on the inclined surface; a connector for attaching an object, the connector disposed on the attaching apparatus and a tether connected to the connector for securing an object; and a coupling connecting together the attaching surface and the platform section;

hooking the anchoring section at or near the peak of the inclined surface on the first side of the inclined surface;

attaching the tether to an individual.

2. The method of claim 1 further comprising:

attaching the tether to a platform section via the connector.

3. The method of claim 1 further comprising:

providing movement for the individual about the inclined surface; and limiting the movement of the individual to within the border of the inclined surface so that individual cannot fall from inclined surface.

4. The method of claim 1 further comprising:

providing a tethering device; and attaching the tethering device to a platform section via the connector.

5. The method of claim 4 further comprising;

rotating the tethering device to allow free motion for the individual about inclined surface.

6. The method of claim 4 further comprising:

coiling the tether within the tethering device.

7. The method of claim 4 further comprising:

extending the tether from the tethering device so that the individual can access locations on the inclined surface at different lengths from the attaching apparatus; and retracting the tether into the tethering device as the individual moves closer to the tethering device.

8. The method of claim 7 further comprising:

halting tether extension when the tether is pulled at a high velocity so that the individual does not fall from the inclined surface.

* * * * *